United States Patent [19]

Skelly et al.

[11] 4,021,059

[45] May 3, 1977

[54] PRODUCTION OF IMAGES

[75] Inventors: James Kenneth Skelly, Wilmslow, England; Michael Farrington, Spartan, South Africa

[73] Assignee: Ciba-Geigy Corporation, Ardsley, N.Y.

[22] Filed: Apr. 23, 1975

[21] Appl. No.: 571,035

[30] Foreign Application Priority Data

Apr. 25, 1974 United Kingdom ..... 18200/74

[52] U.S. Cl. ..... 282/27.5; 106/14.5; 427/150; 427/151; 427/261; 427/288; 428/411; 428/537; 428/914

[51] Int. Cl.[2] ..... B41M 5/22

[58] Field of Search ..... 427/146, 150, 151, 261, 427/256, 288; 428/195, 199, 207, 211, 411, 537, 914, 913; 106/14.5, 20, 22, 23; 282/27.5

[56] References Cited

UNITED STATES PATENTS

| | | | |
|---|---|---|---|
| 2,777,780 | 1/1957 | Cormack et al. | 427/151 X |
| 3,364,052 | 1/1968 | Martino | 427/261 X |
| 3,931,430 | 1/1976 | Tada et al. | 428/195 |

*Primary Examiner*—Thomas J. Herbert, Jr.
*Assistant Examiner*—Bruce M. Hess
*Attorney, Agent, or Firm*—Karl F. Jorda; Prabodh I. Almaula; Edward McC. Roberts

[57] ABSTRACT

An image producing system is provided which comprises a carrier material of fabric, paper, a felt or fabric pad impregnated with a color former solution, comprising a weakly volatile high boiling organic solvent having dissolved therein a color former and a color former deactivating substance, wherein the color former is an azo compound and a substrate which has incorporated therein or possesses at least one surface which is at least partially coated with a color former activating substance or system and a re-activating substance which counteractsthe de-activating substance.

23 Claims, No Drawings

PRODUCTION OF IMAGES

The present invention relates to the production of images by the use of colour formers.

The use of colour formers in self-duplicating stationery has been known for many years, especially in pressure-sensitive duplicating systems. Such systems consist of adjacent sheets of paper in which by pressure writing, e.g. by a ball-point pen or a typewriter, copies are produced on the underlying sheets without the need for interleaved carbon paper. Usually a solution of the colour former is contained in microcapsules which are coated on to the reverse side of the upper sheet and the front side of the bottom sheet or receiving sheet is coated with a co-reactive substance. In systems comprising more than two sheets, the intermediate sheets are coated on each side with the appropriate substance. When writing or typing on the top sheet the capsules are ruptured by impact, the colour former is brought into contact with the co-reactive substrate and a coloured image, being a copy of the original, is produced.

It is not always necessary to produce copies of an original, and in some instances it is even undesirable. We have found that in those cases where an original only is required using colour formers, it is not necessary to encapsulate the colour former. In addition, in the present invention colour formers can be used which are themselves not colourless but undergo a colour change when contacted with a co-reactive substance. In particular, azoic colour formers which are normally yellow in colour, but which undergo a colour change to destroy the yellow and produce a different colour when protonated can be used in the present invention. Such substances are often objectionable in conventional self-duplicating systems because the paper is a pale yellow colour.

According to the present invention there is provided an image producing system which comprises a carrier material impregnated with a solution of a colour former in a weakly volatile high boiling solvent and a colour former de-activating substance, preferably a liquid organic base; and a substrate which has incorporated therein or possesses at least one surface which is at least partially coated with a colour-former activating substance or system and a re-activating substance which counteracts the de-activating substance, and wherein the colour former is an azo compound having the general formula I:

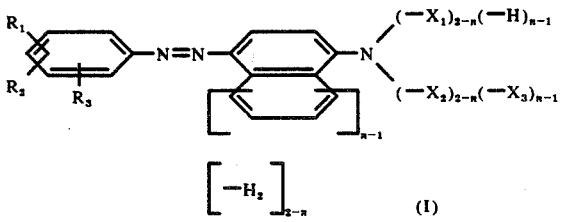

(I)

in which $R_1$, $R_2$ and $R_3$ each represents hydrogen, halogen, alkyl, alkoxy, aryloxy, alkoxycarbonyl, dialkylaminocarbonyl, acylamino, acyl(alkyl)amino,

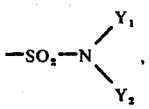

in which $Y_1$ and $Y_2$ each represents alkyl or aryl, or in which $Y_1$ and $Y_2$ together represent an alkylene group; $X_1$ is hydrogen or an alkyl group, $X_2$ is an alkyl, cyanoalkyl or arylmethylene group or $X_1$ and $X_2$ together represent an alkylene group, $X_3$ is an alkyl or aryl group and $n$ is 1 or 2, perferably 1, or of the general formula II:

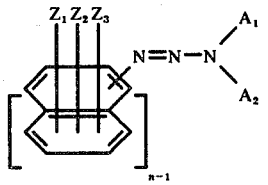

(II)

in which $Z_1$, $Z_2$ and $Z_3$ each represents hydrogen, alkyl, substituted alkyl, alkoxy, halogen, nitro, acylamino, aminoacyl or alkoxycarbonyl, $A_1$ and $A_2$ each represents alkyl or phenyl or $A_1$ and $A_2$ together with the nitrogen atom to which they are bound form a heterocyclic ring system and $n$ is 1 or 2.

When the colour former is a triazene of general formula II it has to be reacted with an azo coupling component before it is capable of forming a colour on a substrate. The azo coupling component may be present either in the carrier material together with the compound of general formula II or in the substrate where it may be in admixture with the colour former activating substance.

The invention also provides a process for producing a coloured image on a substrate by means of a colour former which comprises impregnating a carrier material with a solution of a colour former in a weakly volatile high boiling solvent and a colour former de-activating substance; incorporating into the substrate or at least partially coating the surface of the substrate with a colour former activating substance or system and a re-activating substance which counteracts the de-activating substance, and transferring the colour former on to selected areas of the substrate prepared by one of the methods indicated above to produce the image, and wherein the colour former is an azo compound of the general formulae (I) or (II) defined above.

The colour former activating substance will normally be one which is more acidic than the colour former, and may be any of the substances which are known to activate colour formers. It may be, for example, attapulgite, bentonite, silica, halloysite, kaolin or any acidic or acidified clay, or an acid reacting polymeric material such as a phenolic polymer, a phenol acetylene polymer, a maleic acid-resin or a partially or wholly hydrolysed polymer of maleic anhydride with styrene, ethylene, vinyl methyl ether or carboxy polymethylenes. If the colour former is a triazene compound of general formula II the colour former activating substance will usually be present in admixture with an azo coupling component.

The present invention also provides a solution, in a weakly volatile high boiling solvent having a boiling point of at least 150° C. of a colour former of general formula I or II, defined above, and a colour former de-activating substance, and also a carrier material impregnated with such a solution.

The carrier material which is impregnated with the colour former solution may be a fabric such as is used, for example, in typewriter ribbons, a paper material, possibly in ribbon form, such as crepe paper, wet laid or dry laid paper, or a felt or fabric pad such as are used with a rubber or metal stamp. It is preferred to absorb the colour former on to a fabric ribbon to produce a typewriter ribbon, or on to a felt or fabric pad or into a felt-tipped pen. The colour former is then transferred on to the substrate by typing with the ribbon, by means of a stamp from the pad or by writing with the felt-tipped pen. The carrier material may be impregnated with from 5 – 200% of its dry weight of the colour former solution, preferably from 5 – 100%.

The solvent used to dissolve the colour former may be any weakly volatile high boiling solvent having a boiling point of at least 150° C., preferably at least 300° C. Suitable solvents include, for example, partially hydrogenated terphenyl, liquid paraffin, tricresyl phosphate, di-n-butyl phthalate, dioctyl phthalate, trichlorobenzene, nitrobenzene, trichloroethyl phosphate or water-insoluble hydrocarbon oils, alkyl phthaloyl butyl glycollates, such as propyl-, pentyl-, hexyl- or preferably butyl-phthaloyl butyl glycollate; diethylene glycol, triethylene glycol or polyethylene glycols having a molecular weight of from 200 to 600, e.g. 400. Such solvents may be used alone or in combinations.

The colour former solution may contain up to 10% by weight of the colour former depending on the solubility in the chosen solvent, but is usually used in amounts of from 0.1 – 4% by weight.

Suitable de-activating substances are non-volatile liquid organic bases such as an amine or an alkanolamine, e.g. triethanolamine and diethanolamine.

Suitable re-activating substances are organic acids such as maleic acid, oxalic acid, malonic acid, succinic acid, glutaric acid, adipic acid, tricarballylic acid diglycollic acid, lactic acid, malic acid, tartaric acid, citric acid, pyrophosphoric acid, benzene sulphonic acid, naphthalene-2-sulphonic acid, 1-phenol-4-sulphonic acid, polymaleic acid, co- and ter-polymers of maleic acid with ethyl acrylate and vinyl acetate, hydroxyethane diphosphonic acid and methylamino-N-N-di-methylene-phosphonic acid. The preferred acid is maleic acid.

The amount of de-activating substance impregnated into the carrier material should be sufficient to prevent the colour former from being activated when it contacts a substrate which does not contain a re-activating substance. While in some cases up to 40% of de-activating material, based on the weight of the solvent, may be used, normally up to 10% is sufficient for most substrates. The preferred amount is from 0.4 to 6%, most preferably from 0.4 to 2%, based on the weight of solvent.

The substrate is preferably paper which has been formed using a neutral or alkaline size and thus will not react with the colour former. The paper may be sized with aluminium sulphate, rosin size and sodium aluminate to produce a neutral sized paper, or with a ketone dimer to produce an alkaline sized paper. This assists in controlling the colour forming reaction.

When the colour formers are azo compounds of the formula I, they are preferably those of the general formula III

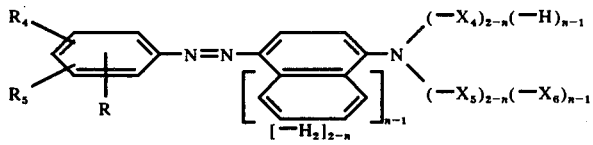

(III)

in which $R_4$, $R_5$ and $R_6$ each represent lower alkyl, lower alkoxy, halogenphenoxy, phenoxy, lower alkoxycarbonyl, lower dialkylaminocarbonyl, acetylamino, halogen, acetyl(lower alkyl)amino,

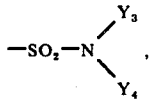

in which $Y_3$ and $Y_4$ each represents lower alkyl or phenyl, or in which $Y_3$ and $Y_4$ together represent an alkylene group with 4 or 5 carbon atoms and, at most two of the radicals $R_4$, $R_5$ and $R_6$ being hydrogen, $X_4$ is hydrogen or lower alkyl, $X_5$ is lower alkyl, lower cyanoalkyl or benzyl, or $X_4$ and $X_5$ together represent an alkylene group with 4 or 5 carbon atoms, $X_6$ is lower alkyl or phenyl and $n$ is 1 or 2.

Of special interest are azo compounds of the formula IV:

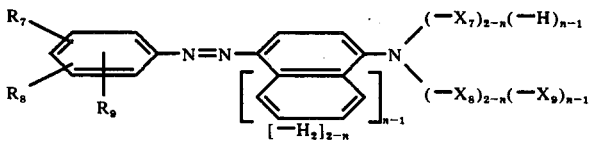

(IV)

in which $R_7$, $R_8$ and $R_9$ each represents methyl, methoxy, phenoxy, dichlorophenoxy, methoxycarbonyl, dimethylaminocarbonyl, acetylamino, chlorine, acetyl(methyl)amino,

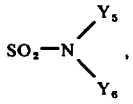

in which $Y_5$ and $Y_6$ each represent methyl, ethyl or phenyl or in which $Y_5$ and $Y_6$ together represent a pentylene group, at most two of the radicals, $R_7$, $R_8$ and $R_9$ being hydrogen, $X_7$ is methyl or ethyl, $X_8$ is methyl, 2-cyanoethyl or benzyl, $X_9$ is methyl or ethyl and $n$ is 1 or 2.

Advantageous results are obtained with colour formers of the formula V:

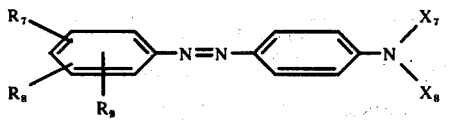

(V)

in which $R_7$, $R_8$, $R_9$, $X_7$ and $X_8$ have the meanings given above, and very suitable are colour formers of the formula VI:

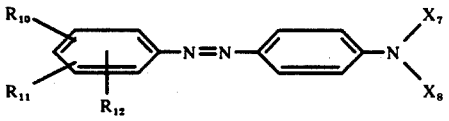

(VI)

in which $R_{10}$, $R_{11}$ and $R_{12}$ each represents methoxy, methoxycarbonyl, chlorine, diethylaminosulfonyl or acetylamino, at most two of the radicals $R_{10}$, $R_{11}$ and $R_{12}$ being hydrogen and $X_7$ and $X_8$ have the meanings given above.

The terms lower alkyl or lower alkoxy in the definitions of radicals of the colour formers means radicals with 1 to 5, especially 1 to 3 carbon atoms, such as methyl, ethyl, propyl, benzyl or amyl.

When one or more of the R-radicals contain acyl groups, the acyl radical may be derived, for example, from an aliphatic monocarboxylic acid having 1 to 4 carbon atoms such as acetic acid.

When one or more of the R-radicals is halogen it is, e.g. iodine, bromine but preferably chlorine.

When $Y_1$ and $Y_2$ or $Y_3$ and $Y_4$ together represent an alkylene group they form together with the nitrogen atom a heterocyclic ring such as piperidine or pyrrolidine.

Aryl radicals in any of the definitions of the colour formers especially mean naphthalene, diphenyl and preferably benzene radicals.

These colour formers may be prepared by conventional methods known in the art, e.g. by diazotizing a substituted aniline and coupling it onto a N-substituted aniline.

Specific Examples of compounds of general formula I which may be used in the present invention are given in Table I, in which *n* in formula I is 1 and in Table II in which *n* in formula I is 2.

Table I

| No. | Substituents in formula I $R_1$ | $R_2$ | $R_3$ | $X_1$ | $X_2$ | Absorption maximum λ max. in nm free base | protonated | Colour of protonated dye |
|---|---|---|---|---|---|---|---|---|
| 1 | —H | —H | 4-$CH_3CONH$ | —$CH_3$ | —$CH_3$ | 411 | 550 | violet |
| 2 | 2-$CH_3$ | —H | —H | —$CH_3$ | —$CH_3$ | 401 | 506 | orange |
| 3 | —H | 3-$CH_3$ | —H | —$CH_3$ | —$CH_3$ | 406 | 520 | red |
| 4 | —H | —H | 4-$CH_3$ | —$CH_3$ | —$CH_3$ | 404 | 528/542 | red |
| 5 | 2-$OCH_3$ | —H | —H | —$CH_3$ | —$CH_3$ | 413 | 540 | violet |
| 6 | —H | —H | 4-$OCH_3$ | —$CH_3$ | —$CH_3$ | 404 | 556 | violet |
| 7 | 2-$OCH_3$ | —H | 4-$OCH_3$ | —$CH_3$ | —$CH_3$ | 412 | 578 | blue-grey |
| 8 | 2-$OCH_3$ | —H | 5-$OCH_3$ | —$CH_3$ | —$CH_3$ | 425 | 560 | grey |
| 9 | —H | 3-Cl | —H | —$CH_3$ | —$CH_3$ | 416 | 510 | orange |
| 10 | —H | —H | 4-Cl | —$CH_3$ | —$CH_3$ | 415 | 519 | orange |
| 11 | —H | 3-Cl | 4-$CH_3$ | —$CH_3$ | —$CH_3$ | 413 | 510 | orange |
| 12 | 2-$CH_3$ | —H | 4-Cl | —$CH_3$ | —$CH_3$ | 414 | 506 | orange |
| 13 | 2-$CH_3$ | —H | 5-Cl | —$CH_3$ | —$CH_3$ | 418 | 506 | orange |
| 14 | 2-$OCH_3$ | 4-$OCH_3$ | 5-Cl | —$CH_3$ | —$CH_3$ | 420 | 574 | green-grey |
| 15 | 2-$OC_6H_5$ | —H | 5-Cl | —$CH_3$ | —$CH_3$ | 430 | 518 | orange |
| 16 | 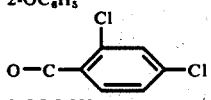 | —H | —H | —$CH_3$ | —$CH_3$ | 418 | 518 | orange |
| 17 | 2-$COOCH_3$ | —H | —H | —$CH_3$ | —$CH_3$ | 417 | 518 | cerise red |
| 18 | —H | 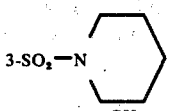 | 4-$CH_3$ | —$CH_3$ | —$CH_3$ | 420 | 514 | orange |
| 19 | —H | 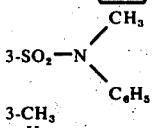 | 4-$CH_3$ | —$CH_3$ | —$CH_3$ | 419 | 517/535 | orange |
| 20 | —H | 3-$CH_3$ | 4-$OCH_3$ | —$CH_3$ | —$CH_3$ | 408 | 542 | brown |
| 21 | —H | —H | 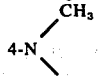 | —$CH_3$ | —$CH_3$ | 418 | 520 | orange |
| 22 | —H | —H | 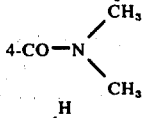 | —$CH_3$ | —$CH_3$ | 421 | 516 | orange |
| 23 | —H | —H | 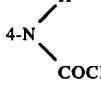 | —$CH_3$ | —$CH_2CH_2CN$ | 405 | 556 | violet |
| 24 | —H | 3-$CH_3$ | —H | —$CH_3$ | —$CH_2CH_2CN$ | 356 | 522/538 | red |
| 25 | —H | —H | 4-$CH_3$ | —$CH_3$ | —$CH_2CH_2CN$ | 396 | 534 | brown |
| 26 | 2-$OCH_3$ | —H | —H | —$CH_3$ | —$CH_2CH_2CN$ | 400 | 542 | brown |
| 27 | 2-$OCH_3$ | —H | 5-$OCH_3$ | —$CH_3$ | —$CH_2CH_2CN$ | 416 | 566 | grey |
| 28 | —H | 3-Cl | —H | —$CH_3$ | —$CH_2CH_2CN$ | 406 | 513/534 | orange |
| 29 | —H | —H | 4-Cl | —$CH_3$ | —$CH_2CH_2CN$ | 404 | 523/541 | orange |
| 30 | —H | 3-Cl | 4-$CH_3$ | —$CH_3$ | —$CH_2CH_2CN$ | 404 | 523/540 | orange |
| 31 | —H | 3-$CH_3$ | —H | —$C_2H_5$ | —$CH_2$—$C_6H_5$ | 400 | 524/543 | brown-orange |

Table I-continued

| No. | Substituents in formula I $R_1$ | $R_2$ | $R_3$ | $X_1$ | $X_2$ | Absorption maximum λ max. free base | in nm protonated | Colour of protonated dye |
|---|---|---|---|---|---|---|---|---|
| 32 | 2-$COOCH_3$ | —H | —H | —$C_2H_5$ | —$CH_2$—$C_6H_5$ | 418 | 527/542 | red |
| 33 | 2-$CH_3$ | 3-Cl | —H | —$CH_3$ | —$CH_3$ | 413 | 500 | orange |
| 34 | 2-O—$C_6H_5$ | —H | 5-t-$C_5H_{11}$ | —$CH_3$ | —$CH_3$ | 416 | 526 | orange |
| 35 | —H | —H | 4-$OCH_3$ | —$CH_3$ | —$CH_2CH_2CN$ | 398 | 555 | brown |
| 36 | 2-$OCH_3$ | 4-$OCH_3$ | 5-Cl | —$CH_3$ | —$CH_2CH_2CN$ | 412 | 574 | brown-green |
| 37 | 2-$OCH_3$ | —H | -5-$SO_2$—N($C_2H_5$)($C_2H_5$) | —$CH_3$ | —$CH_3$ | 427 | 522 | violet |

*Colour here refers to protonation in a solution of 95% acetic acid.

Table II

| No. | Substituents in formula I $R_1$ | $R_2$ | $R_3$ | $X_3$ | Absorption maximum λ max. free base | in nm protonated | Colour of protonated dye |
|---|---|---|---|---|---|---|---|
| 101 | —H | 3-$SO_2$—N( 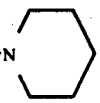 ) | 4-$CH_3$ | —$C_2H_5$ | | | violet |
| 102 | —H | 3-$SO_2$—N($CH_3$)($CH_3$) | 4-$CH_3$ | —$C_2H_5$ | | | violet |
| 103 | 2-$CH_3$ | —H | 4-Cl | —$C_2H_5$ | 466 | 540 | violet |

When the colour former is one of general formula II, defined above, alkyl and alkoxy in the definitions of $Z_1$, $Z_2$, $Z_3$, $A_1$ and $A_2$ usually are lower alkyl or alkoxy, which as a rule do not contain more than 4 carbon atoms, e.g. n-butyl, n-butoxy, n-propyl, isopropyl, ethyl, ethoxy, methyl or methoxy. Substituents for alkyl in $Z_1$, $Z_2$ or $Z_3$, e.g. are halogen, hydroxy or lower alkoxy.

The term "halogen" may represent iodine, but preferably bromine or chlorine. The term acylamino preferably means a radical of an aliphatic or aromatic sulfonic or particularly carboxylic acid amide whereby the amide nitrogen may be substituted by lower alkyl. Especially preferred are radicals of an alkane carboxylic acid amide, where the amide nitrogen optionally is substituted by methyl, such as a formic acid amide, acetic acid amide or propionic acid amide radical or radicals of a benzene carboxylic acid amide such as benzoic acid amide.

The term aminoacyl as a rule stands for an amine substituted —CO— or —$SO_2$— group. The amine radical thereby may be of a primary or secondary aliphatic or an heterocyclic amine. Preferred triazenes correspond to the formula VII.

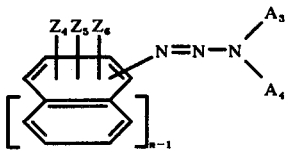

(VII)

in which $Z_4$, $Z_5$ and $Z_6$ each represents hydrogen, alkyl with 1 to 4 carbon atoms, alkoxy with 1 to 4 carbon atoms, halogen, nitro, —N(—$X_1$)—CO—$X_2$ or

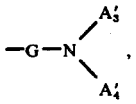

or $COOX_3$, $X_1$ and $X_2$ each representing hydrogen, alkyl with 1 to 4 carbon atoms or phenyl, $X_3$ represents alkyl with 1 to 4 carbon atoms, G is —CO— or —$SO_2$—, $A_3$, $A_4$, $A_3'$ and $A_4'$ each represent alkyl with 1 to 4 carbon atoms or phenyl or $A_3$ and $A_4$, and $A_3'$ and $A_4'$ respectively together with the nitrogen atom to which they are bound form a heterocyclic ring system with one or two rings, each ring containing 5 to 7 ring members and $n$ is 1 or 2.

Of special interest are triazines of the formula VIII:

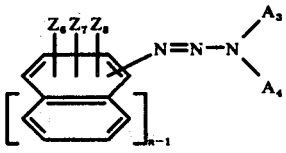

(VIII)

in which $Z_7$ and $Z_8$ each represent hydrogen, alkyl with 1 to 4 carbon atoms, alkoxy with 1 to 4 carbon atoms or halogen, and $Z_6$, $A_3$, $A_4$ and $n$ have the meaning given above.

Advantageous results are obtained with colour formers of the formula IX:

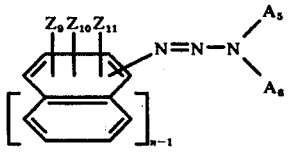

(IX)

in which $Z_9$ represents hydrogen, alkyl with 1 to 2 carbon atoms, alkoxy with 1 or 2 carbon atoms, halogen, nitro, —N(—$X_4$)— CO—$X_5$,

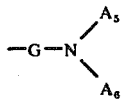

or —COOX$_6$, X$_4$ represents hydrogen, alkyl with 1 or 2 carbon atoms or phenyl, X$_5$ represents alkyl with 1 or 2 carbon atoms, X$_6$ represents alkyl with 1 or 2 carbon atoms or phenyl, Z$_{10}$ and Z$_{11}$ each represent hydrogen, alkyl with 1 or 2 carbon atoms, alkoxy with 1 or 2 carbon atoms or halogen, G represents —CO— or —SO$_2$—; A$_5$, A$_6$, A$_5'$ and A$_6'$ each represents alkyl with 1 or 2 carbon atoms or phenyl or A$_5$ and A$_6$ and A$_5'$ and A$_6'$ respectively together with the nitrogen atoms to which they are bound form a heterocyclic ring system with one or two rings consisting of carbon, nitrogen and at most one oxygen as ring members, each ring containing 5 to 7 ring members and the ring system containing at most 10 ring members.

Very suitable colour formers are triazenes of the formula X:

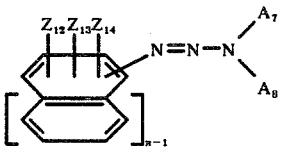

(X)

in which Z$_{12}$ represents hydrogen, methyl, methoxy, chlorine, nitro,

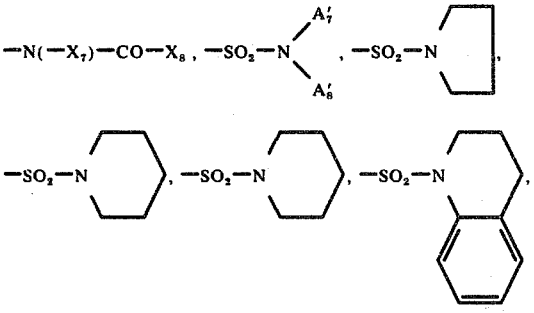

-continued

—CO—N(CH$_3$)$_2$ or —COOCH$_3$,

Z$_{13}$ is hydrogen, methyl, methoxy or chlorine
Z$_{14}$ is hydrogen or methoxy
A$_7'$ is methyl, ethyl or phenyl
A$_8'$ is methyl, ethyl or hydrogen
A$_7$ is methyl, ethyl or phenyl
A$_8$ is methyl or ethyl or A$_7$ and A$_8$ together with the nitrogen atom to which they are bound represent

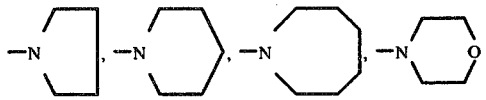

X$_7$ is hydrogen or methyl, X$_8$ is methyl or phenyl and *n* is 1 or 2.

These colour formers as such either are well known or may be prepared by conventional methods known in the art. A general method e.g. can be described thus:

The primary aromatic amine is dissolved in hydrochloric acid and water, then the solution is cooled to 0° C with ice. Sodium nitrite is added beneath the surface at such a rate that a slight excess of nitrous acid is always present. When the diazotisation is complete the reaction mixture is added to a solution or suspension of the secondary amine and sodium hydrogen carbonate in water at 10° C. The reaction mixture is stirred and allowed to reach room temperature. Stirring is continued until no diazonium compound can be detected. The product is out of solution and is filtered off or extracted into an organic solvent, washed with water and dried in vacuo at temperature below 50° C.

The colour formers as such are colourless and can form coloured images when brought into contact with a typical azoic coupling substance and an acidic active substrate, that is a solid electron coupling substance.

Suitable colour formers of the formula II e.g. are:

Table III

| | symbols in formula (II) | | | | | | |
|---|---|---|---|---|---|---|---|
| No. | Z$_1$ | Z$_2$ | Z$_3$ | n | position —N=N | A$_1$ | A$_2$ |
| 6.1 | 3-SO$_2$N(CH$_3$)$_2$ | 4-CH$_3$ | H | I | I | —CH$_3$ | —CH$_3$ |
| 6.2 | | | | | | —C$_2$H$_5$ | —C$_2$H$_5$ |
| 6.3 | | | | | | 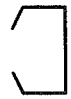 | |
| 6.4 | | | | | | 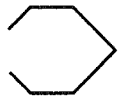 | |
| 6.5 | | | | | | 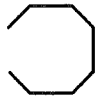 | |
| 6.6 | | | | | | 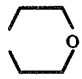 | |
| 6.7 | 3-SO$_2$N(C$_2$H$_5$)$_2$ | | | | | —CH$_3$ | —CH$_3$ |

Table III-continued

| No. | symbols in formula (II) | | | | | | |
|---|---|---|---|---|---|---|---|
| | $Z_1$ | $Z_2$ | $Z_3$ | n | position —N=N | $A_1$ | $A_2$ |
| 6.8 | | | | | | | |
| 6.9 | | | | | | | |
| 6.10 | | | | | | | |
| 6.11 | 3-$SO_2$—N | | | | | —$CH_3$ | —$CH_3$ |
| 6.12 | | | | | | | |
| 6.13 | | | | | | | |
| 6.14 | | | | | | | |
| 6.15 | | | | | | | |
| 6.16 | 3-$SO_2$—N | | | | | —$CH_3$ | —$CH_3$ |
| 6.17 | | | | | | | |
| 6.18 | | | | | | | |
| 6.19 | | | | | | | |
| 6.20 | | | | | | | |
| 6.21 | 3-$SO_2$—N | 4-$CH_3$ | H | I | I | —$CH_3$ | —$CH_3$ |
| 6.22 | | | | | | | |
| 6.23 | | | | | | | |

Table III-continued

| | symbols in formula (II) | | | | | | |
|---|---|---|---|---|---|---|---|
| No. | $Z_1$ | $Z_2$ | $Z_3$ | n | position —N=N | $A_1$ | $A_2$ |
| 6.24 | | | | | | | |
| 6.25 | | | | | | | |
| 6.26 | 3-$SO_2$—NH—$C_6H_5$ | | | | | | |
| 6.27 | 3-$SO_2$—N($CH_3$)($C_6H_5$) | | | | | —$CH_3$ | —$CH_3$ |
| 6.28 | | | | | | | |
| 6.29 | | | | | | | |
| 6.30 | | | | | | | |
| 6.31 | | | | | | | |
| 6.32 | 3-$SO_2$—N($C_2H_5$)($C_6H_5$) | 4 $CH_3$ | H | | | | |
| 6.33 | 3-$SO_2$—N | | | | | —$CH_3$ | —$CH_3$ |
| 6.34 | | | | | | —$C_2H_5$ | —$C_2H_5$ |
| 6.35 | | | | | | | |
| 6.36 | | | | | | | |
| 6.37 | | | | | | | |
| 6.38 | 4-N($CO—CH_3$)($CH_3$) | H | | | | | |
| 6.39 | 4-NH—CO—$C_6H_5$ | 2-$OCH_3$ | 5-$OCH_3$ | | | | |
| 6.40 | 4-CO—N($CH_3$)($CH_3$) | H | H | | | | |
| 6.41 | 2-$COOCH_3$ | | | | | | |

Table III-continued

| No. | symbols in formula (II) $Z_1$ | $Z_2$ | $Z_3$ | n | position —N=N | $A_1$ | $A_2$ |
|---|---|---|---|---|---|---|---|
| 6.42 | 4-$NO_2$ | H | H | I | I | | |
| 6.43 | 4-Cl | 2-$CH_3$ | | | | | |
| 6.44 | 5-$OCH_3$ | 2-$OCH_3$ | | | | | |
| 6.45 | 4-$OCH_3$ | | | | | | |
| 6.46 | | | 5-Cl | | | | |
| 6.47 | 4-$SO_2N(C_2H_5)$ | H | H | | | | |
| 6.48 | 4-$SO_2$—N | | | | | | |
| 6.49 | 2-$SO_2N(C_2H_5)(C_6H_5)$ | | | | | | |
| 6.50 | 3-$SO_2$—N | | | | | | |
| 6.51 | 5-$SO_2N(C_2H_5)_2$ | 2-$OCH_3$ | | | | | |
| 6.52 | | | | | | | |
| 6.53 | 4-Cl | 2-$CH_3$ | | | | —$CH_3$ | —$C_6H_5$ |
| 6.54 | 4-$OCH_3$ | 2-$OCH_3$ | | | | | |
| 6.55 | 5-$OCH_3$ | 2-$OCH_3$ | H | | | | |
| 6.56 | 5-Cl | 2-Cl | | | | | |
| 6.57 | | 2-$CH_3$ | | | | | |
| 6.58 | 4-$SO_2N(C_2H_5)_2$ | H | | | | —$CH_3$ | —$CH_3$ |
| 6.59 | 4-$SO_2$—N | | | | | | |
| 6.60 | 5-$SO_2$—$N(C_2H_5)_2$ | | | | | —$C_2H_5$ | —$C_2H_5$ |
| 6.61 | —H | | | 2 | | | |
| 6.62 | 5-$SO_2$—$N(C_2H_5)_2$ | | | | | | |
| 6.63 | 4-$SO_2$—N | | | | | | |
| 6.64 | 6-$SO_2$—N | | | | | | |
| 6.65 | 5-$SO_2$—$N(C_2H_5)_2$ | | | | | | |
| 6.66 | 5-$SO_2$—$N(C_2H_5)_2$ | | | | | —$CH_3$ | —$CH_3$ |

When a triazene compound of formula II is used as colour former the azo coupling component preferably is a naphthalene, benzene, pyrazolone or quinoline or more particularly a naphthol or a naphthylamine.

Among the naphthol those of the formula

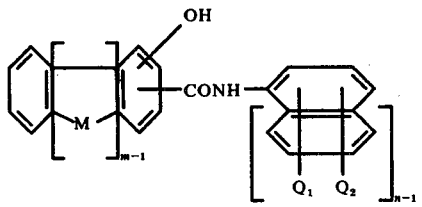

(XI)

are of special interest, in which M is —NH—, —S— or —O—, $Q_1$ and $Q_2$ each represent hydrogen, nitro, halogen, alkyl with 1 to 4 carbon atoms or alkoxy with 1 to 4 carbon atoms, *m* and *r* are each 1 or 2.

Naphthylamines which are very valuable correspond to the formula

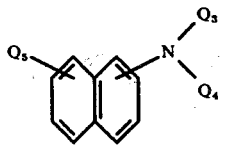

(XII)

in which $Q_3$ and $Q_4$ each represent hydrogen, alkyl with 1 to 4 carbon atoms, benzyl or phenyl or where $Q_3$, $Q_4$ and the nitrogen atom to which they are bound together form a heterocyclic ring system with one or two rings consisting of carbon, nitrogen and at most one oxygen as ring members, each ring containing 5 to 7 ring members and the ring system containing at most 10 ring members and $Q_5$ is hydrogen or a sulfonic acid group.

All the azo couplers suitable for use in the present invention are of the well known couplers used for making azo dyestuffs and they thus are known as such and are prepared by well known methods.

The following naphthols of formula XI e.g. are very suitable as coupling components:

TABLE IV

| | symbols in formula (XI) | | | | | | |
|---|---|---|---|---|---|---|---|
| No. | position of —OH | position of —CONH | m | M | r | $Q_1$ | $Q_2$ |
| 8.1 | 2 | 3 | 1 | — | 1 | H | H |
| 8.2 | 2 | 3 | 1 | — | 1 | 4-Cl | H |
| 8.3 | 2 | 3 | 1 | — | 1 | 4-Cl | 2-$CH_3$ |
| 8.4 | 2 | 3 | 1 | — | 1 | H | 2-$OCH_3$ |
| 8.5 | 2 | 3 | 1 | — | 1 | H | 2-$CH_3$ |
| 8.6 | 2 | 3 | 1 | — | 1 | 3-$NO_2$ | H |
| 8.7 | 2 | 3 | 1 | — | 1 | 5-$OCH_3$ | 2-$OCH_3$ |
| 8.8 | 2 | 3 | 1 | — | 1 | 4-$OCH_3$ | H |
| 8.9 | 2 | 3 | 1 | — | 1 | 4-$OCH_3$ | 3-Cl |
| 8.10 | 2 | 3 | 1 | — | 1 | 5-Cl | 2-$CH_3$ |
| 8.11 | 2 | 3 | 1 | — | 1 | 4-$CH_3$ | H |
| 8.12 | 3 | 4 | 2 | NH | 1 | 4-Cl | H |
| 8.13 | 2 | 3 | 2 | O | 1 | 5-$OCH_3$ | 2-$OCH_3$ |
| 8.14 | 2 | 3 | 1 | — | 2 | H | H |

Naphthylamines of formula XII e.g. are:

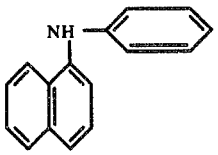

(9.1)

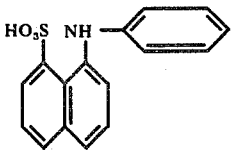

(9.2)

Further suitable azo couplers correspond to these formulae:

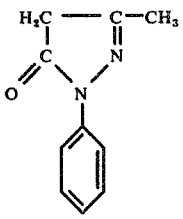

(10.1)

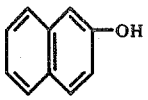

(10.2)

-continued

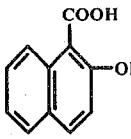

(10.3)

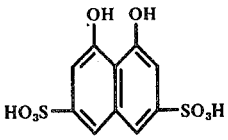

(10.4)

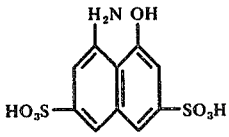

(10.5)

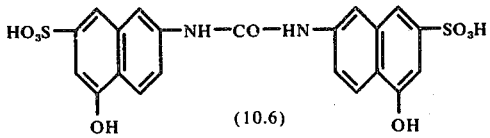

(10.6)

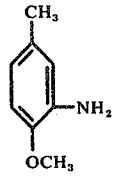

(10.7)

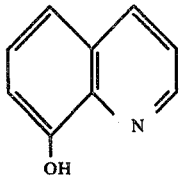

(10.8)

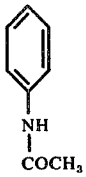

(10.9)

With these colour formers a large variety of colours may be produced ranging from orange to violet. Mixtures of such color formers are suitable to give neutral shades such as grey. A special advantage of the triazenes is the light fastness of the colours they produce.

If desired the colour formers containing an azo group of formulae I or II, defined above, can be used in admixture with other known colour formers, such as crystal violet lactone (CVL) or benzoyl leuco methylene blue (BLMB) in order to change the colour of the image produced. In addition the colour former may be admixed with a dyestuff which is soluble in the solvent used to produce different colour effects.

The invention will be illustrated by the following Examples in which percentages are by weight.

EXAMPLE 1

An alkaline sized paper was coated with Sylton clay, one sample of which was then overprinted with maleic acid, and another sample was used as a blank.

Colour former solutions containing 0.4% of the colour former No. 32 in Table 1 in diethylene glycol containing various concentrations of triethanolamine (0.4%, 0.8%, 1.2%, 1.6% and 2.0%) were impregnated on to a stamp pad and then transferred to the paper by a rubber stamp.

When stamped on to the blank, no reaction was observed with any of the colour former solutions. When stamped on the paper coated with maleic acid an instantaneous reaction occurred, producing a red colour.

EXAMPLE 2

Example 1 was repeated except that the colour former was replaced by others listed in Table I. The colour formers used and the resulting colours when stamped onto paper overprinted with maleic acid are shown in the following Table:

| No. of colour former in Table I | Colour of image obtained |
|---|---|
| 1 | lilac |
| 3 | red |
| 5 | violet |
| 6 | red-violet |
| 7 | blue |
| 10 | red |
| 14 | violet-blue |
| 15 | cerise red |
| 17 | cerise red |
| 18 | bright red |
| 21 | light red |
| 22 | light red |
| 23 | light red |
| 28 | orange |
| 29 | orange-red |
| 32 | violet |
| 33 | ochre yellow |
| 34 | brown |
| equal parts 7 + 18 | grey-violet |
| 2 parts 7 + 1 part 18 | blue violet |
| equal parts 17 + CVL | violet |
| equal parts 17 + BLMB | red changing to violet |
| equal parts 17 + 18 + CVL + BLMB | violet |

EXAMPLE 3

Example 1 was repeated, except that the colour formers were chosen from those listed in Table III above. The substrate was coated on one side with attapulgus clay mixed with 2.5% of a coupler chosen from Table IV above, and then overprinted with maleic acid. The compounds used and the resulting colours are shown in the following Table:

| Colour Former No. | Coupler No. | Colour of image on attapulgus |
|---|---|---|
| 6.1 | 8.7 | orange-red |
| 6.2 | 8.7 | orange-red |
| 6.3 | 8.7 | orange-red |
| 6.4 | 8.7 | orange-red |
| 6.5 | 8.7 | orange-red |
| 6.6 | 8.7 | orange-red |
| 6.7 | 8.7 | orange-red |
| 6.8 | 8.7 | orange-red |
| 6.9 | 8.7 | orange-red |
| 6.10 | 8.7 | orange-red |
| 6.11 | 8.7 | orange-red |
| 6.12 | 8.7 | orange-red |
| 6.13 | 8.7 | orange-red |
| 6.14 | 8.7 | orange-red |
| 6.15 | 8.7 | orange-red |
| 6.16 | 8.7 | orange-red |
| 6.17 | 8.7 | orange-red |
| 6.18 | 8.7 | orange-red |
| 6.19 | 8.7 | orange-red |
| 6.20 | 8.7 | orange-red |
| 6.23 | 8.7 | orange-red |
| 6.27 | 8.7 | orange-red |
| 6.28 | 8.7 | orange-red |
| 6.29 | 8.7 | orange-red |
| 6.30 | 8.7 | orange-red |
| 6.31 | 8.7 | orange-red |
| 6.32 | 9.1 | violet |
| 6.32 | 10.2 | yellowish red |
| 6.32 | 10.7 | bluish red |
| 6.32 | 9.2 | red |
| 6.32 | 8.1 | red |
| 6.32 | 8.7 | yellowish red |
| 6.32 | 8.5 | yellowish red |
| 6.32 | 8.8 | red |
| 6.32 | 8.10 | red |
| 6.40 | 8.1 | red |
| 6.40 | 8.2 | red |
| 6.40 | 8.3 | red |
| 6.40 | 8.4 | red |
| 6.40 | 8.5 | red |
| 6.40 | 8.6 | red |
| 6.40 | 8.7 | red |

-continued

| Colour Former No. | Coupler No. | Colour of image on attapulgus |
|---|---|---|
| 6.40 | 8.8 | red |
| 6.40 | 8.9 | red |
| 6.40 | 8.10 | red |
| 6.40 | 8.11 | red |
| 6.40 | 8.14 | red |
| 6.40 | 10.6 | red |
| 6.43 | 10.2 | orange |
| 6.43 | 10.7 | orange |
| 6.44 | 10.2 | red |
| 6.44 | 10.7 | red |
| 6.48 | 8.7 | bluish red |
| 6.49 | 8.7 | yellowish red |
| 6.50 | 8.7 | red |
| 6.54 | 9.1 | violet |
| 6.54 | 10.2 | yellowish red |
| 6.54 | 10.7 | bluish red |
| 6.54 | 9.2 | red |
| 6.54 | 8.1 | red |
| 6.54 | 8.7 | yellowish red |
| 6.54 | 8.5 | yellowish red |
| 6.54 | 8.8 | red |
| 6.54 | 8.10 | red |
| 6.55 | 9.1 | red |
| 6.55 | 10.2 | violet |
| 6.55 | 10.7 | bluish violet |
| 6.55 | 9.2 | reddish grey |
| 6.55 | 8.1 | violet |
| 6.55 | 8.7 | violet |
| 6.55 | 8.5 | grey-violet |
| 6.55 | 8.8 | grey-violet |
| 6.55 | 8.10 | grey-violet |
| 6.61 | 8.7 | purple |
| 6.62 | 8.7 | red-violet |
| 6.63 | 8.7 | red-violet |
| 6.64 | 8.7 | red-violet |
| 6.65 | 8.7 | red-violet |
| 6.66 | 8.7 | red-violet |

EXAMPLE 4

Example 3 was repeated except that the following colour formers and coupling components were used:

| Colour former | | Coupler | | Colour of |
|---|---|---|---|---|
| No. | % | No. | % | image |
| 6.66 | 3 | 8.11 | 2.25 | red |
| | | 10.1 | 0.25 | |
| 6.66 | 3 | 8.11 | 1.8 | orange |
| | | | 0.6 | |
| 6.66 | 3 | 10.1 | 2.5 | yellow |
| 6.66 | 3 | 10.9 | 2.5 | yellow |
| 6.65 | 1.5 | 8.11 | 2.5 | blue |
| | | | | blue-violet |
| 6.65 | 1.5 | 8.11 | 1.8 | blue-grey |
| CVL | 1.5 | 10.9 | 0.6 | |
| 6.65 | 1.5 | 10.1 | 2.5 | blue-green |
| CVL | 1.5 | | | |
| 6.65 | 1.5 | 10.9 | 2.5 | blue-green |
| CVL | 1.5 | | | |

EXAMPLE 5

Example 1 was repeated, except that attapulgus clay was used and was incorporated in the mass of the paper to ash 10%. Similar results were obtained.

EXAMPLE 6

Example 2 was repeated, except that attapulgus clay was used and was incorporated in the mass of the paper to ash 10%. Similar results were obtained.

EXAMPLE 7

Example 1 was repeated, except that the solvent used was butyl phthaloyl butyl glycollate instead of diethylene glycol. Similar results were obtained.

EXAMPLE 8

Example 1 was repeated, except that the solvent used was a partially halogenated terphenyl. Similar results were obtained.

EXAMPLE 9

Plain unfilled paper was coated with a composition comprising:

8.0 parts maleic acid
0.64 parts low viscosity sodium carboxy methyl cellulose
0.13 parts methylolated melamine formaldehyde condensate
2.0 parts glycerine
11.36 parts water This was then stamped with an ink comprising:

0.8 parts Colour Former No. 32 in Table 1
6.0 parts diethenolamine
93.2 parts diethylene glycol An instant strong red colour was produced.

We claim:

1. An image producing system which comprises a carrier material of fabric, paper, a felt or fabric pad impregnated with a colour former solution, comprising a weakly volatile high boiling organic solvent having a boiling point of at least 150° C and having dissolved therein a color former and as a colour former de-activating substance a non-volatile liquid alkanol amine, wherein the color former is an azo compound having the general formula I:

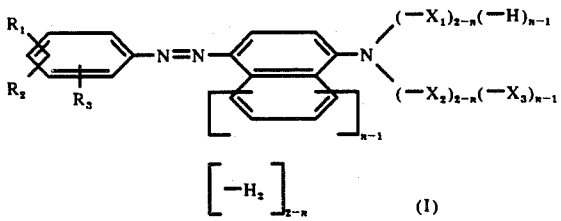

(I)

in which $R_1$, $R_2$ and$R_3$ each represents hydrogen, halogen, alkyl, alkoxy, aryloxy, alkoxycarbonyl, dialkylaminocarbonyl, acylamino, acyl(alkyl)amino,

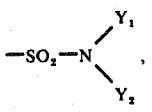

in which $Y_1$ and $Y_2$ each represents alkyl or aryl, or in which $Y_1$ and $Y_2$ together represent an alkylene group; $X_1$ is hydrogen or an alkyl group, $X_2$ is an alkyl, cyanoalkyl or arylmethylene group or $X_1$ and $X_2$ together represent an alkylene group, $X_3$ is an alkyl or aryl group and $n$ is 1 or 2, preferably 1, or of the general formula II:

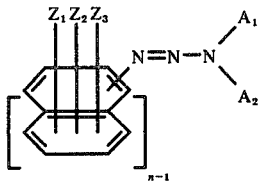

(II)

in which $Z_1$, $Z_2$ and $Z_3$ each represents hydrogen, alkyl, substituted alkyl, alkoxy, halogen, nitro, acylamino, aminoacyl or alkoxycarbonyl, $A_1$ and $A_2$ each represents alkyl or phenyl or $A_1$ and $A_2$ together with the nitrogen atom to which they are bound form a heterocyclic ring system and $n$ is 1 or 2; and a substrate which has incorporated therein or possesses at least one surface which is at least partially coated with a colour former activating substance or system and a re-activating organic acid which counteracts the de-activating substance and in which, when the color former corresponds to formula II, the color activating substance is present in admixture with an azo coupling component.

2. A system as claimed in claim 1, in which the colour former solutions contains up to 10% by weight of colour former.

3. A system as claimed in claim 1, in which the alkanolamine is triethanolamine or diethanolamine.

4. A system as claimed in claim 1, in which the solvent contains up to 40% by weight of de-activating substance.

5. A system as claimed in claim 4, in which the solvent contains from 0.4 to 6% by weight of de-activating substance.

6. A system as claimed in claim 1, in which the colour former has the general formula (III):

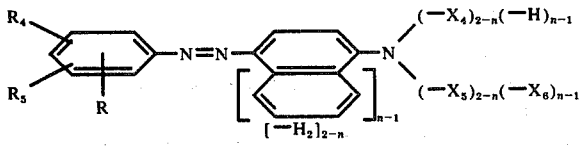

(III)

in which $R_4$, $R_5$ and $R_6$ each represent lower alkyl, lower alkoxy, halogenphenoxy, phenoxy, lower alkoxycarbonyl, lower dialkylaminocarbonyl, acetylamino, halogen, acetyl(lower alkyl)amino,

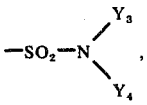

in which $Y_3$ and $Y_4$ each represents lower alkyl or phenyl, or in which $Y_3$ and $Y_4$ together represent an alkylene group with 4 or 5 carbon atoms and, at most two of the radicals $R_4$, $R_5$ and $R_6$ being hydrogen, $X_4$ is hydrogen or lower alkyl, $X_5$ is lower alkyl, lower cyanoalkyl or benzyl, or $X_4$ and $X_5$ together represent an alkylene group with 4 or 5 carbon atoms, $X_6$ is lower alkyl or phenyl and $n$ is 1 or 2.

7. A system as claimed in claim 6, in which the colour former has the general formula IV:

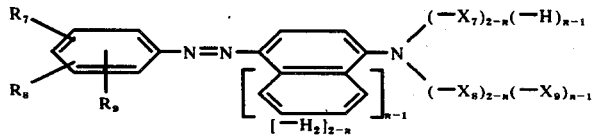

(IV)

in which $R_7$, $R_8$ and $R_9$ each represents methyl, methoxy, phenoxy, dichlorophenoxy, methoxycarbonyl, dimethylaminocarbonyl, acetylamino, chlorine, acetyl(methyl)amino,

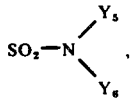

in which $Y_5$ and $Y_6$ each represent methyl, ethyl or phenyl or in which $Y_5$ and $Y_6$ together represent a pentylene group, at most two of the radicals, $R_7$, $R_8$ and $R_9$ being hydrogen, $X_7$ is methyl or ethyl, $X_8$ is methyl, 2-cyanoethyl or benzyl, $X_9$ is methyl or ethyl and $n$ is 1 or 2.

8. A system as claimed in claim 7, in which the colour former has the general formula (V)

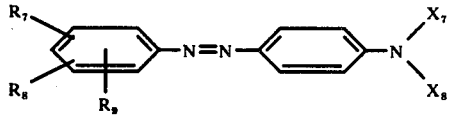

(V)

in which $R_7$, $R_8$, $R_9$, $X_7$ and $X_8$ have the meanings given in claim 7.

9. A system as claimed in claim 8, in which the colour former has the general formula VI:

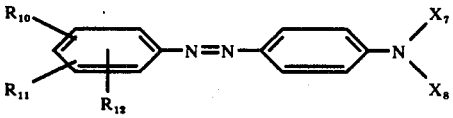

(VI)

in which $R_{10}$, $R_{11}$ and $R_{12}$ each represents methoxy, methoxycarbonyl, chlorine, diethylaminosulfonyl or acetylamino, at most two of the radicals $R_{10}$, $R_{11}$ and $R_{12}$ being hydrogen and $X_7$ and $X_8$ have the meanings given in claim 8.

10. A system as claimed in claim 1, in which the colour former has the general formula VII:

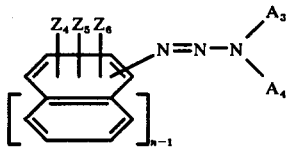

(VII)

in which $Z_4$, $Z_5$ and $Z_6$ each represents hydrogen, alkyl with 1 to 4 carbon atoms, alkoxy with 1 to 4 carbon atoms, halogen, nitro, —N(—$X_1$)—CO—$X_2$ or

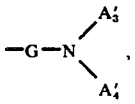

or $COOX_3$, $X_1$ and $X_2$ each representing hydrogen, alkyl with 1 to 4 carbon atoms or phenyl, $X_3$ represents alkyl with 1 to 4 carbon atoms, G is —CO— or —$SO_2$—, $A_3$, $A_4$, $A_3'$ and $A_4'$ each represent alkyl with 1 to 4 carbon atoms or phenyl or $A_3$ and $A_4$, and $A_3'$ and $A_4'$ respectively together with the nitrogen atom to which they are bound form a heterocyclic ring system with one or two rings, each ring containing 5 to 7 ring members and $n$ is 1 or 2.

11. A system as claimed in claim 10, in which the colour former has the general formula VIII:

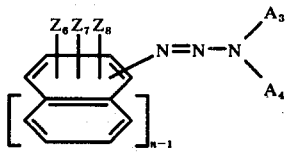

(VIII)

in which $Z_7$ and $Z_8$ each represent hydrogen, alkyl with 1 to 4 carbon atoms, alkoxy with 1 to 4 carbon atoms or halogen and $Z_6$, $A_3$, $A_4$ and $n$ have the meanings given in claim 10.

12. A system as claimed in claim 11, in which the colour former has the general formula IX:

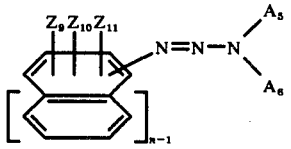

(IX)

in which $Z_9$ represents hydrogen, alkyl with 1 to 2 carbon atoms, alkoxy with 1 or 2 carbon atoms, halogen, nitro, —N(—$X_4$)—CO—$X_5$,

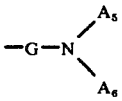

or —$COOX_6$, $X_4$ represents hydrogen, alkyl with 1 or 2 carbon atoms or phenyl, $X_5$ represents alkyl with 1 or 2 carbon atoms, $X_6$ represents alkyl with 1 or 2 carbon atoms or phenyl, $Z_{10}$ and $Z_{11}$ each represent hydrogen, alkyl with 1 or 2 carbon atoms, alkoxy with 1 or 2 carbon atoms or halogen, G represents —CO— or —$SO_2$—; $A_5$, $A_6$, $A_5'$ and $A_6'$ each represents alkyl with 1 or 2 carbon atoms or phenyl or $A_5$ and $A_6$ and $A_5'$ and $A_6'$ respectively together with the nitrogen atoms to which they are bound form a heterocyclic ring system with one or two rings consisting of carbon, nitrogen and at most one oxygen as ring members, each ring containing 5 to 7 ring members and the ring system containing at most 10 ring members.

13. A system as claimed in claim 11, in which the colour former has the general formula X:

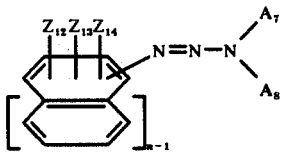

(X)

in which $Z_{12}$ represents hydrogen, methyl, methoxy, chlorine, nitro,

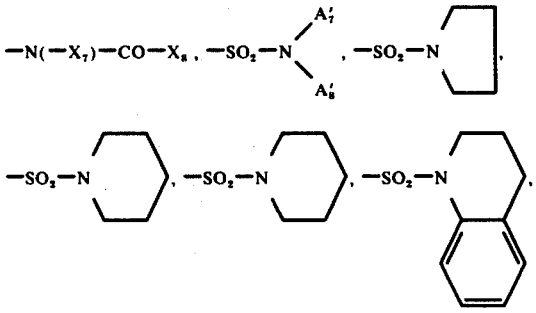

$-CO-N(CH_3)_2$ or $-COOCH_3$, $Z_{13}$ is hydrogen, methyl, methoxy or chlorine
$Z_{14}$ is hydrogen or methoxy
$A_7'$ is methyl, ethyl or phenyl
$A_8'$ is methyl, ethyl or hydrogen
$A_7$ is methyl, ethyl or phenyl
$A_8$ is methyl or ethyl or $A_7$ and $A_8$ together with the nitrogen atom to which they are bound represent

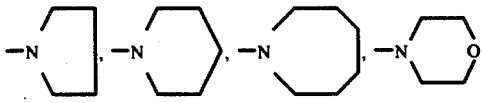

14. A system as claimed in claim 1, in which the carrier material is impregnated with from 5 – 200% of its dry weight of the colour former solution.

15. A system as claimed in claim 1, in which the colour former activating substance is attapulgite, bentonite, silica, halloysite, kaolin or any acidic or acidified clay, or a phenolic polymer, a phenol acetylene polymer, a maleic acid-rosin resin or a partially or wholly hydrolysed polymer of maleic anhydride with styrene, ethylene, vinyl methyl ether or carboxy polymethylenes.

16. A system as claimed in claim 1, in which the organic acid is maleic acid, oxalic acid, malonic acid, succinic acid, glutaric acid, adipic acid, tricarballylic acid diclycollic acid, lactic acid, malic acid, tartaric acid, citric acid, pyrophosphoric acid, benzene sulphonic acid, naphthalene-2- sulphonic acid, 1-phenol-4-sulphonic acid, polymaleic acid, co- and ter-polymers of maleic acid with ethyl acrylate and vinyl acetate, hydroxyethane diphosphonic acid, methylamino-N-N-di-methylenephosphonic acid.

17. A system as claimed in claim 1, in which the azo coupling component is a naphthalene, benzene, pyrazolone or quinoline coupling component.

18. A system as claimed in claim 17, in which the azo coupling component is a naphthol of general formula XI:

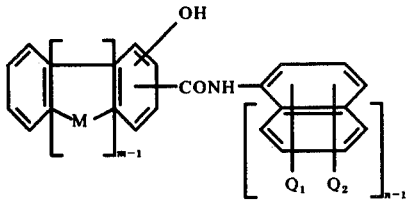

(XI)

in which M is —NH—, —S— or —O—, $Q_1$ and $Q_2$ each represent hydrogen, nitro, halogen, alkyl with 1 to 4 carbon atoms or alkoxy with 1 to 4 carbon atoms, *m* and *r* each 1 or 2.

19. A system as claimed in claim 17, in which the azo coupling component is a naphthylamine of general formula XII:

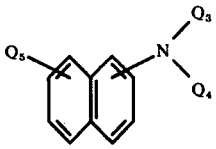

(XII)

in which $Q_3$ and $Q_4$ each represent hydrogen, alkyl with 1 to 4 carbon atoms, benzyl or phenyl or where $Q_3$, $Q_4$ and the nitrogen atom to which they are bound together form a heterocyclic ring system with one or two rings consisting of carbon, nitrogen and at most one oxygen as ring members, each ring containing 5 to 7 ring members and the ring system containing at most 10 ring members and $Q_5$ is hydrogen or a sulphonic acid group.

20. A system as claimed in claim 1, in which the substrate is a neutral or alkaline sized paper.

21. A process for producing a coloured image on a substrate by means of a colour former which comprises impregnating a carrier material with a colour former solution as defined in claim 1, incorporating into the substrate or at least partially coating the surface of the substrate with a colour former activating substance or system and a re-activating substance which counteracts the de-activating substance and transferring the colour former on to selected areas of the substrate to produce an image.

22. A colour former solutions comprising a weakly volatile high boiling organic solvent having dissolved therein a colour former and a colour former de-activating substance, wherein the colour former is an azo compound having the general formula I or II as defined in claim 1.

23. A carrier material of fabric paper, a felt or fabric pad impregnated with a colour former solution as claimed in claim 22.

* * * * *